US005636285A

United States Patent [19]

Sauer

[11] Patent Number: 5,636,285

[45] Date of Patent: Jun. 3, 1997

[54] VOICE-CONTROLLED HEARING AID

[75] Inventor: Joseph Sauer, Strullendorf, Germany

[73] Assignee: Siemens Audiologische Technik GmbH, Erlangen, Germany

[21] Appl. No.: 429,608

[22] Filed: Apr. 27, 1995

[30] Foreign Application Priority Data

Jun. 7, 1994 [DE] Germany ..... 44 19 901.5

[51] Int. Cl.[6] ..... H04R 25/00

[52] U.S. Cl. ..... 381/68.2; 381/68

[58] Field of Search ..... 381/68, 68.2, 68.4, 381/23.1; 379/447

[56] References Cited

U.S. PATENT DOCUMENTS 4,790,019 12/1988 Hueber .
4,845,755 7/1989 Busch et al. .
5,524,150 6/1996 Sauer ..... 381/68

FOREIGN PATENT DOCUMENTS 0 064 042 11/1993 European Pat. Off. .

OTHER PUBLICATIONS

"Brockhaus–Enzyklopädie", pp. 701 –702 (1993).

"Neue Entwicklungen in der Högerätetechnik," Pasemann, Medizinelektronik, vol. 8, No. 1 (1994), pp. 30–33.

*Primary Examiner*—Sinh Tran
*Attorney, Agent, or Firm*—Hill, Steadman & Simpson

[57] ABSTRACT

In order to make the operation, control and/or program selection of a hearing aid easier and in order to make manual operations and actuation means superfluous, the operation (switching on/off, setting softer/louder, selection of a program matched to an auditory/ambient situation) or the control of a part that influences the transmission characteristic of the amplifier ensues in the hearing aid by recognizing and evaluating a code word spoken by the hearing aid user.

14 Claims, 1 Drawing Sheet

VOICE-CONTROLLED HEARING AID

BACKGROUND OF THE INVENTION

1. Field of the Invention

The present invention is directed to a hearing aid of the type having a microphone for the reception of useful audio signals and for generating electrical signals corresponding to the audio signals, an amplifier for amplifying the electrical signals from the microphone and for supplying the amplified and processed signals to an electroacoustic transducer (earphone) that is designed for converting the amplified and processed signals into acoustic signals that can be supplied to the tympanic membrane of a hearing-impaired person.

2. Description of the Prior Art

Hearing aids should be as small as possible so that they can be inconspicuously worn. Small, miniature hearing aids are worn at the head behind the ear (BTE hearing aids) or in the concha (concha hearing aids) or in the auditory canal (ITE hearing aids). For manual operation, these hearing aids have, for example, an on/off switch, a switch for switching between "normal" operation using the microphone and operation in a telephone coil mode, and a volume control (potentiometer). Mechanical switches are also provided for modifying the transmission characteristic of the hearing aid.

More recent, programmable hearing aids have an electronic memory in which a number of transmission characteristics matched to various auditory/ambient situations can be stored. When, for example, the hearing aid wearer moves from a quiet environment into a noisy environment or vice versa, then he or she can match the hearing aid to the respective situation by actuating a switch or by selecting a specific, stored program. An example of such a hearing aid is disclosed in European 0 064 042.

Older hearing-impaired persons, in particular, often have difficulty in manipulating the miniature switches and therefore hearing aids having remote control by ultrasound (European Application 0 175 909), infrared or radio signals have been developed. An additional, larger control device with a transmitter is required for this purpose. Manual instruction signals must be transmitted to the hearing aid with a key field at the control device, and then must be received by the hearing aid and decoded in a special circuit and converted into the control signal corresponding to the desired function. Whereas the first-cited hearing aids have the disadvantage that manipulation of the operating elements becomes more difficult as the overall device becomes smaller is, hearing aids using a remote control unit have the disadvantage that always taking the larger control device along is required.

SUMMARY OF THE INVENTION

An object of the present invention is to provide a hearing aid of the type initially generally described wherein the operation, switching or control thereof is achieved without the necessity of physically touching switch means on the hearing aid and without the use of additional remote control devices.

The above object is inventively achieved in a hearing aid having means for recognizing and evaluating control words spoken by the person wearing the hearing aid and for converting the spoken control words into respective control signals for activating various hearing aid functions, such as volume adjustment, changing transmission characteristics, or switching between operating modes.

In addition to the standard signal path of the hearing aid for signal processing of the useful audio signals received by the microphone which proceeds via an amplifier to the earphone and which has an acoustic signal output to the tympanic membrane of the hearing-impaired person, the hearing aid of the invention has a further signal path by means of which the hearing aid receives phonetic control signals (commands) of the hearing aid wearer, recognizes and evaluates these phonetic signals, and converts them into electrical control signals that trigger hearing aid functions corresponding to the instructions of the hearing aid wearer.

In an embodiment, a sensor and a voice decoder connected thereto are provided in the hearing aid. Voice signals of the hearing-impaired person picked up by the sensor are identified in the voice decoder as voice signal patterns of the hearing-impaired person by comparison with signal patterns previously produced by the wearer which are stored in a memory. The identified phonetic signals are converted into electrical control signals by a processor in a further signal path. These electrical control signals, allocated to specific instructions of the hearing-impaired person, trigger, for example, the activation or deactivation of the hearing aid, volume adjustment, or switching of the amplifier to various, programmable transmission characteristics that are matched to different auditory/ambient situations.

In an embodiment of the hearing aid of the invention, the microphone that is already present for conventional use is also used as in the voice (phonetic command) input unit, such that instructions of the hearing aid wearer are picked up via the microphone in the form of code words and can be supplied to the voice decoder or to a voice analysis unit. Using a processor or microprocessor, the control instructions are then implemented when the control signals derived from the spoken words coincide in a check with the words or voice pattern signals stored in the voice pattern memory.

Protection against miscontrol can be provided in the check of the incoming instruction signals so that, for example phonemes which may arise during normal conversation that happen to coincide with or resemble a phonetic command, will not activate the signal path for the operating and control signal. According to one embodiment, for example, a switch can be arranged in the signal path for the incoming signals, which the hearing aid wearer must actuate before the entry of phonetic instructions to the hearing aid.

DESCRIPTION OF THE PREFERRED EMBODIMENTS

Figure 1:
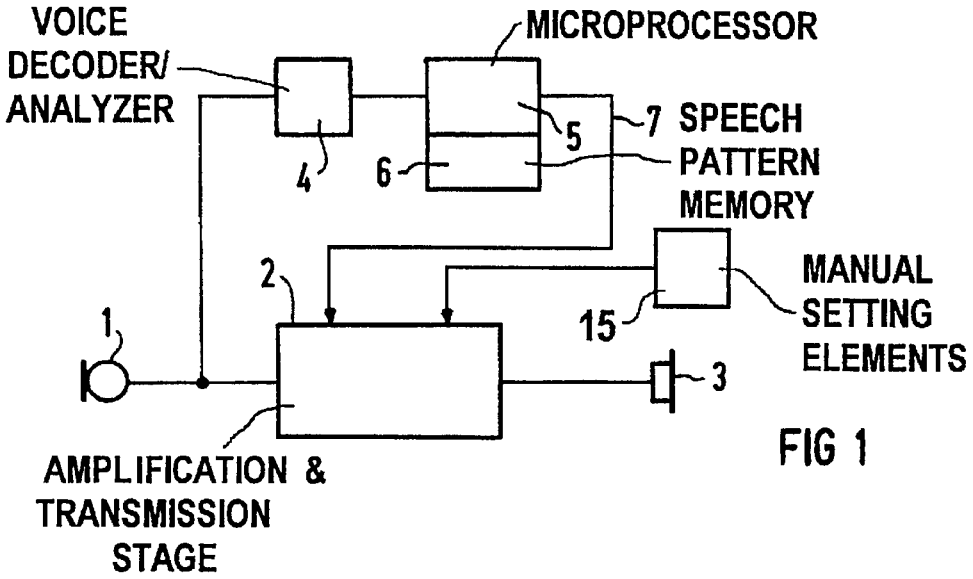
FIG. 1 is a block circuit diagram of a hearing aid constructed in accordance with the principles of the present invention having a unit for recognizing and evaluating code words spoken by the hearing-impaired person for the operation and/or control of the hearing aid.

The hearing aid shown schematically and simplified in FIG. 1 has a first signal branch for processing the useful audio signals which includes a microphone 1 which picks up the acoustic signals. This acoustic information is converted into electrical signals in the microphone 1. After signal processing in an amplifier in an amplification and transmission stage 2, the electrical signal is supplied to an earphone 3 serving as the output transducer. The earphone 3 converts the electrical useful signals back into acoustic signals that are emitted to the tympanic membrane of the hearing-impaired person.

In order to make an additional acoustic transducer or sensor for the reception of acoustic control instructions or operating instructions of the hearing aid wearer superfluous, a measurement or input quantity that is processed in a second signal path can be taken from the signal path between the microphone 1 and the amplification and transmission stage 2 according to the exemplary embodiment. To permit the hearing aid wearer to enter instructions into the hearing aid phonetically in the form of voice commands instead of manually or by remote control, a voice decoder 4 (voice analyzer) is provided in the second signal path for the recognition and evaluation of respective code words spoken by the hearing aid user. Via a processor 5, the code word to be analyzed, or more precisely, a control signal corresponding to this code word, is compared to individual voice pattern signals stored in a speech pattern memory 6. Given proper identification of the code word, the processor effects the operation or control or switching of the hearing aid requested by the hearing aid wearer. The output 7 of the second signal path can thereby be conducted to the amplifier or other signal processing components of the amplification and transmission stage 2 in the first signal path.

The hearing aid wearer can transmit acoustic commands to his or her hearing aid via the microphone 1. The hearing aid wearer can switch the hearing aid on or off with code words (commands) such as "on" or "off". Without manual actuation of a volume control, the hearing aid wearer can modify the volume gain of the hearing aid on the basis of stored code words and corresponding, spoken instructions such as "softer" or "louder". When the hearing aid is a programmable hearing aid in which transmission characteristics matched to different auditory/ambient situations are stored, then the hearing aid wearer can select the individual, stored programs with, for example, code words such as "program 1" or "program 2". Particularly when matching the hearing aid to the hearing impairment of the hearing-impaired person, the invention offers the possibility of modifying specific parameters for the signal transmission characteristic with phonetic inputs or commands. The code words of the hearing-impaired person are preferably entered and stored in the speech pattern memory 6 during the adaptation of the hearing aid undertaken by an acoustician.

In order to keep the code words which must be remembered simple and at a minimum number, the hearing aid can still be provided with standard manual setting elements 15, and only a few selected operations may be controlled by voice activation.

Dependent on the desired embodiment of the hearing aid, the stored code words can also be erased and replaced by new code words, so that foreign language terms or dialect expressions can also be selected as code words by means of the processor 5. Alternatively, the hearing aid manufacturer can prescribe permanently stored code words by means of the processor that the user must adhere to. When a number of code word commands can be linked to one another, then the processor 5 of the hearing aid, in collaboration with the amplification and transmission stage 2, and the memory 6, can control the transmission characteristic of the hearing aid, using variable parameters are variable insofar as this is meaningful.

When permanently prescribed voice or speech patterns are stored in the speech pattern memory, then the input via the microphone may possibly have to be repeated until the stored voice pattern coincides with that of the spoken code word. A random-access memory (RAM) can be provided, however, for the speech pattern signals in order to be able to take foreign languages or dialects spoken by the respective user of the hearing aid into consideration.

Figure 3:
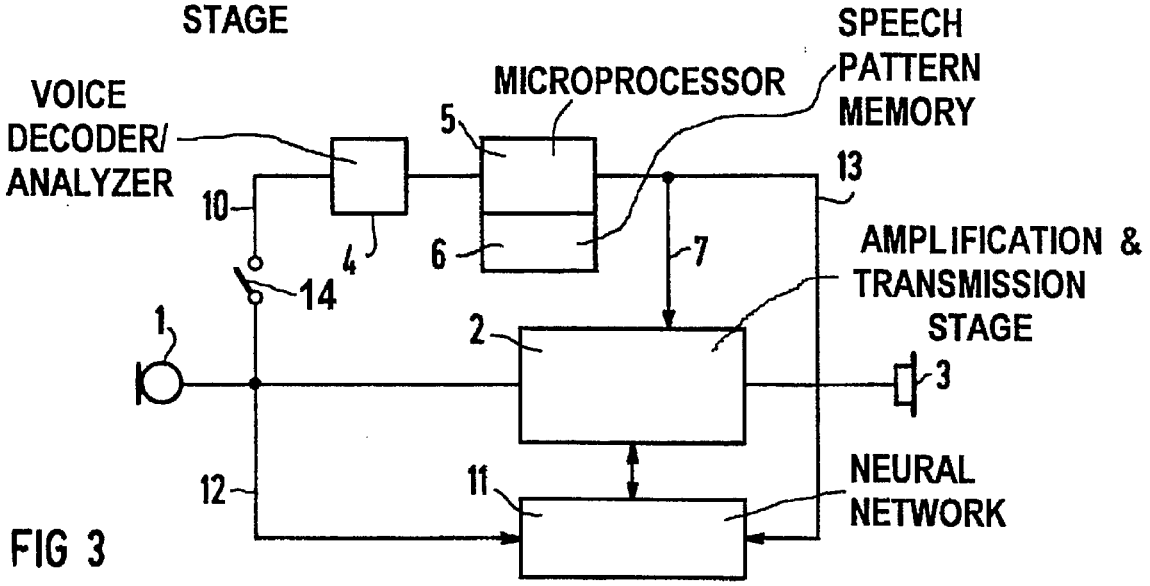
FIG. 3 is a block circuit diagram of an embodiment of a hearing aid according to FIG. 1 wherein voice control is accomplished using a neural network.

According to the invention, it is advantageous that no additional switch and operating elements are required at the hearing aid, however, for users for whom switch manipulation is not difficult, a manually activatable switch 14 may be included in the signal path for the incoming audio signals, which must be actuated before those audio signals (commands) will be entered into the hearing aid (see FIG. 3). This will prevent the possibility of a command word which may be spoken during normal conversation being interpreted as a command which alters the hearing aid operation unintentionally. An additional control or remote control device with a transmitter as well as with a receiver in the hearing aid is also eliminated. The hearing aid of the invention is relatively resistant to interference. No further receiver components are required given employment of the microphone 1 that is already present, because the useful audio signals to be received and the phonetic instructions of the hearing aid wearer lie in the voice frequency range.

Figure 2:
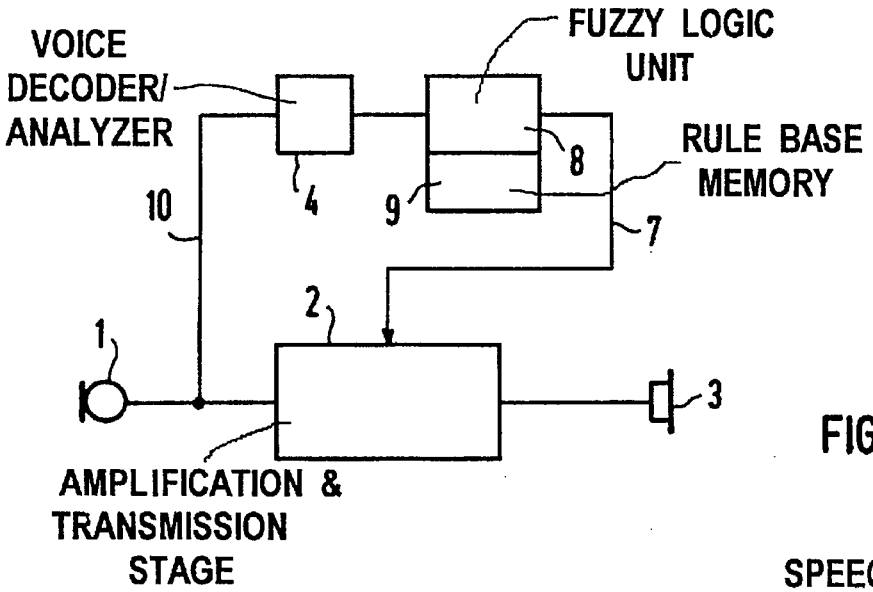
FIG. 2 is a block circuit diagram of an embodiment of hearing aid according to FIG. 1 wherein voice control is accomplished using fuzzy logic.

A further simplification of the phonetic control of the hearing aid is achieved in the embodiment of FIG. 2 wherein a fuzzy logic unit 8 is provided for processing the voice signals identified in the voice decoder/analyzer 4 as control instructions of the hearing-impaired person. The fuzzy logic unit 8 processes these voice signals (control instructions) converted into control signals according to processing rules that can be stored in a rule base memory 9 of the fuzzy logic unit 8 to form control signals that trigger the switching events at the hearing aid. In the embodiment of FIG. 2, also, a control signal path 10 from the sensor output or microphone output via the voice decoder/analyzer 4 and the fuzzy logic unit 8 with memory 9 to the amplification and transmission stage 2 exists in parallel with the signal path from the microphone 1 via the amplification and transmission stage 2 to the earphone 3.

According to the embodiment of FIG. 3, the hearing aid can be equipped with a trainable system for phonetic operation or control. In accord therewith, a neural network 11 is provided having an input side to which the useful audio signals of the first signal path as well as the control signals of the second signal path can be supplied. The neural network 11 calculates the control signals that trigger the required switching events and thereby has recourse to preceding signal combinations between useful signals and control signals that were executed taking the control instructions of the hearing-impaired person into consideration. The embodiment of FIG. 3 also has a first control signal path 10 from the sensor output or microphone output via the voice decoder/analyzer 4 and the processor 5 with the memory 6 to the amplification and transmission stage 2 via line 7 as well as a second control signal path from the sensor output or microphone output via the neural network 11 to the amplification and transmission stage 2 in parallel with the useful signal path from the microphone 1 via the amplification and transmission stage 2 to the earphone 3. The neural network 11 can be supplied with the sensor or microphone signal and with signals from the first signal path via a signal line 13. In this embodiment the amplification and transmission stage 2 can include known circuitry which gives priority to instructions received on line 7 over instructions received from the neural network 11, so that if different or conflicting instructions are present, the instruction from line 7 "overrides" the instruction from the neural network 11.

Although modifications and changes may be suggested by those skilled in the art, it is the intention of the inventor to embody within the patent warranted hereon all changes and modifications as reasonably and properly come within the scope of his contribution to the art.

I claim as my invention:

1. A hearing aid comprising:

a microphone for receiving incoming audio signals and for generating electrical signals corresponding to said incoming audio signals;

means for processing said electrical signals to produce processed electrical signals, said means for processing including an amplifier with an adjustable gain for setting a volume and having settable amplifier transmission characteristics;

an electro-acoustic transducer, supplied with said processed electrical signals, for converting said processed electrical signals into acoustic signals and for emitting said acoustic signals to a hearing-impaired person;

on-off means for setting and deactivating at least one of said microphone, said means for processing and said electro-acoustic transducer; and a voice control circuit having means for receiving a spoken command, means for recognizing said spoken command as being spoken by said hearing-impaired person, processor means for evaluating said spoken command and for converting said spoken command into an electrical control signal for setting at least one of the gain of said amplifier, the transmission characteristics of said amplifier and said on-off means.

2. A hearing aid as claimed in claim 1 wherein said means for receiving said spoken command comprises a sensor for picking up said spoken command in the form of a code word, and wherein said means for recognizing and said processor means for evaluating said spoken command and for converting said spoken command into an electrical control signal comprise a speech pattern memory containing stored speech patterns of said hearing-impaired person, each speech pattern having a control signal associated therewith, voice decoder/analyzer means for comparing an incoming code word to said speech patterns stored in said speech pattern memory, and means, given coincidence of said code word with one of said speech patterns, for emitting the electrical control signal associated with said one of said speech patterns.

3. A hearing aid as claimed in claim 2 wherein said means for emitting said electrical control signal associated with said one of said speech patterns comprises a processor in said hearing aid.

4. A hearing aid as claimed in claim 1 wherein said means for recognizing and said processor means comprise fuzzy logic means for generating said electrical control signal according to fuzzy logic rules and including memory means for storing said fuzzy logic rules as a rule base.

5. A hearing aid as claimed in claim 4 wherein said microphone has an output at which said electrical signals corresponding to said incoming audio signals are present, wherein said means for processing comprises a control signal input and a useful signal input, wherein said voice control circuit comprises a first signal path, connecting said output of said microphone to said control signal input of said means for processing, and said hearing aid further comprising a second signal path, separate from said first signal path, connecting said output of said microphone to said useful signal input of said means for processing.

6. A hearing aid as claimed in claim 1 wherein said microphone has an output at which said electrical signals corresponding to said incoming audio signals are present, wherein said means for processing comprises a control signal input and a useful signal input, wherein said voice control circuit comprises a first signal path, connecting said output of said microphone to said control signal input of said means for processing, and said hearing aid further comprising a second signal path, separate from said first signal path, connecting said output of said microphone to said useful signal input of said means for processing.

7. A hearing aid as claimed in claim 6 wherein said means for processing comprises a further control input, and said hearing aid further comprising neural network means, having a first input connected to said first signal path and a second input connected to said second signal path and an output connected to said further control input of said means for processing, for generating additional control signals for said means for processing dependent on preceding combinations between respective signals on said first and second signal paths.

8. A hearing aid as claimed in claim 7 further comprising a third signal path, separate from said first and second signal paths, connecting said second input of said neural network means to said second signal path.

9. A hearing aid as claimed in claim 1 wherein a single microphone comprises said microphone for receiving incoming audio signals and said means for receiving a spoken command.

10. A hearing aid as claimed in claim 1 further comprising a manually actuatable switch connected in said voice control circuit to said means for receiving a spoken command, which must first be manually actuated before a spoken command received by said means for receiving a spoken command is transmitted to a remainder of said voice control circuit.

11. A hearing aid as claimed in claim 1 wherein said means for recognizing and said processor means include memory means for storing a plurality of speech patterns respectively corresponding to different spoken commands enterable into said memory means during adaptation of said hearing aid.

12. A hearing aid as claimed in claim 1 wherein said means for recognizing and said processor means comprise means for linking a plurality of said spoken commands together to form combined spoken commands, each combined spoken command having a control signal associated therewith and speech pattern memory means containing speech patterns corresponding to a plurality of said combined spoken commands and means, given coincidence of a combined spoken command with a speech pattern of said combined spoken command, for emitting an electrical control signal associated with one of said combined spoken commands.

13. A hearing aid as claimed in claim 2 wherein said means for recognizing and said processor means further comprise means for controlling said speech pattern memory means for substituting a different control signal for said control signal associated with said one on said speech patterns.

14. A hearing aid as claimed in claim 1 further comprising manually actuatable means for manually separately setting at least one of the gain of said amplifier, the transmission characteristics of said amplifier and said on-off means.

* * * * *